US010960427B2

(12) United States Patent
Sauer

(10) Patent No.: US 10,960,427 B2
(45) Date of Patent: Mar. 30, 2021

(54) DEVICE FOR APPLYING A VISCOUS MATERIAL

(71) Applicant: Atlas Copco IAS GmbH, Bretten (DE)

(72) Inventor: Michael Sauer, Bretten (DE)

(73) Assignee: Atlas Copco IAS GmbH, Bretten (DE)

( * ) Notice: Subject to any disclaimer, the term of this patent is extended or adjusted under 35 U.S.C. 154(b) by 97 days.

(21) Appl. No.: 16/342,227

(22) PCT Filed: Sep. 8, 2017

(86) PCT No.: PCT/EP2017/072538
§ 371 (c)(1),
(2) Date: Apr. 16, 2019

(87) PCT Pub. No.: WO2018/091159
PCT Pub. Date: May 24, 2018

(65) Prior Publication Data

US 2019/0255553 A1 Aug. 22, 2019

(30) Foreign Application Priority Data

Nov. 17, 2016 (DE) ..... 10 2016 013 723.1

(51) Int. Cl.
*B05B 15/658* (2018.01)
*B05C 5/02* (2006.01)

(52) U.S. Cl.
CPC ..... *B05B 15/658* (2018.02); *B05C 5/0216* (2013.01)

(58) Field of Classification Search
None
See application file for complete search history.

(56) References Cited

U.S. PATENT DOCUMENTS 1,924,637 A * 8/1933 Carpenter ..... A61C 17/0202 251/285
2003/0145887 A1* 8/2003 Jou ..... F01M 11/045 137/205

(Continued)

FOREIGN PATENT DOCUMENTS

DE 39 31 849 A1 4/1991
DE 20 2007 016237 U1 2/2008
DE 10 2012 108697 A1 3/2014

OTHER PUBLICATIONS

English translation of the International Preliminary Report on Patentability and Written Opinion of the International Searching Authority in PCT/EP2017/072538, dated May 31, 2019.

(Continued)

*Primary Examiner* — Jethro M. Pence
(74) *Attorney, Agent, or Firm* — Collard & Roe, P.C.

(57) ABSTRACT

The invention relates to a device (10) for applying a viscous material to a workpiece, in particular for applying an adhesive or sealing material to a motor vehicle body component, comprising: an application nozzle (14) with a material outlet opening (20); and a nozzle support (16) that supports the application nozzle (14), on which nozzle support the application nozzle (14) is releasably attached, wherein an application channel (18) extends through the nozzle support (16) and the application nozzle (14) up to the material outlet opening (20). According to the invention, the nozzle support (16) and the application nozzle (14) each have a connection part (22, 24), wherein a first connection part (22) is inserted into a second connection part (24) and is encircled thereby, and the connection parts (22, 24) can be moved relative to each other in a limited extent from a starting position against the restoring force of an elastic restoring element (38).

7 Claims, 2 Drawing Sheets

(56) References Cited

U.S. PATENT DOCUMENTS

Figure 1:
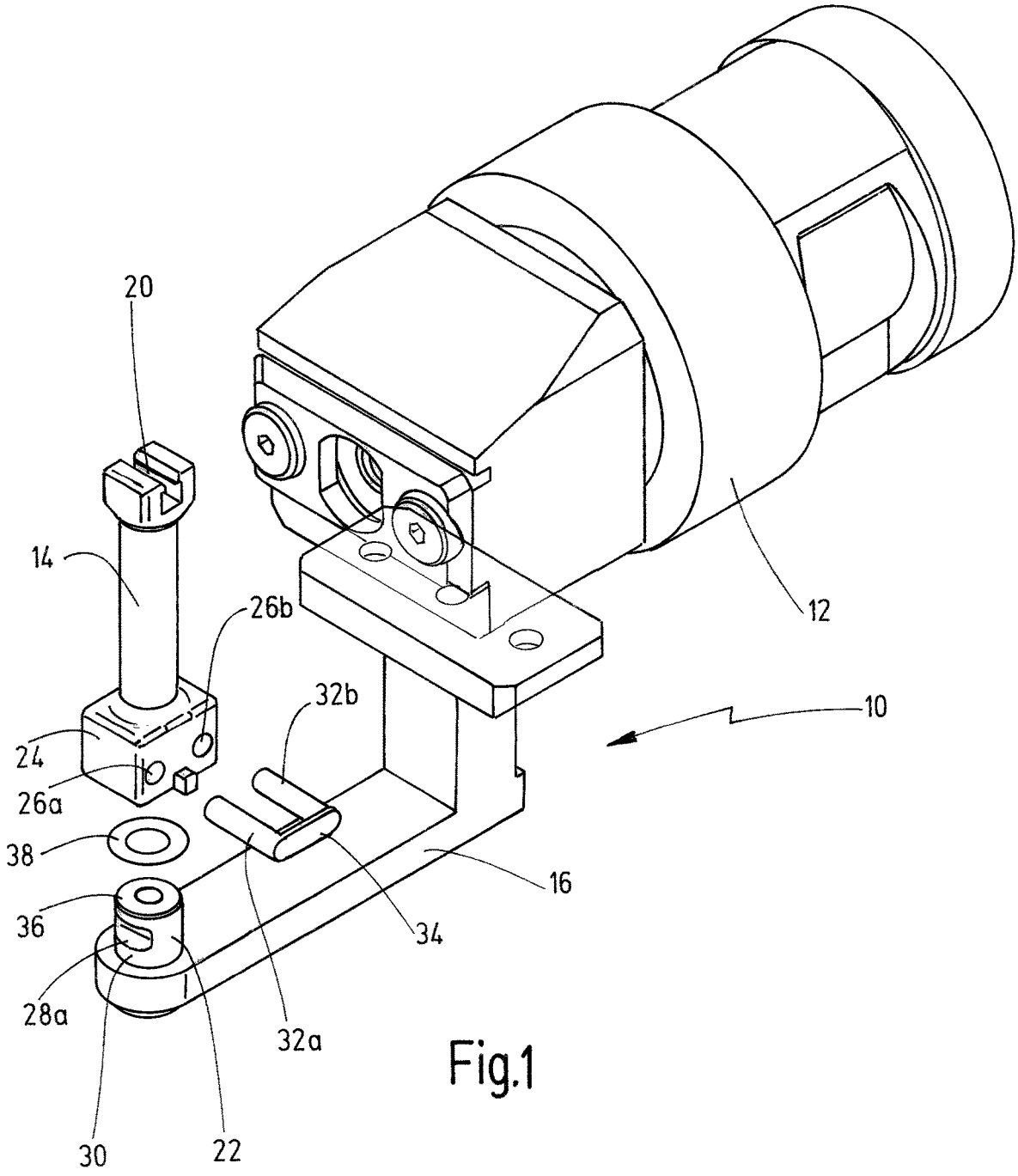

| | | | | |
|---|---|---|---|---|
| 2010/0075058 | A1 | 3/2010 | Rademacher et al. | |
| 2015/0218024 | A1* | 8/2015 | Haase | C02F 3/10 210/188 |

OTHER PUBLICATIONS

International Search Report in PCT/EP2017/072538, dated Dec. 11, 2017.

* cited by examiner

DEVICE FOR APPLYING A VISCOUS MATERIAL

CROSS REFERENCE TO RELATED APPLICATIONS

This application is the National Stage of PCT/EP2017/072538 filed on Sep. 8, 2017, which claims priority under 35 U.S.C. § 119 of German Application No. 10 2016 013 723.1 filed on Nov. 17, 2016, the disclosure of which is incorporated by reference. The international application under PCT article 21(2) was not published in English.

The invention relates to an apparatus for application of a viscous material onto a workpiece, especially for application of an adhesive or sealing compound onto a motor-vehicle body structural part, according to the preamble of claim 1.

Such application apparatuses already find broad use in the application of adhesive and sealing compounds onto body structural parts in the fabrication of motor vehicles. In the process, an application nozzle having a material outlet opening is mounted on a nozzle carrier, which in turn is usually mounted on a robot arm. An application duct extends through the nozzle carrier and the application nozzle up to the material outlet opening, in which the material to be applied is introduced by means of one or more supply lines. In this case, the connection between application nozzle and nozzle carrier is rigid. Especially when the application nozzle is guided along the workpiece in contact therewith, the connection of the application nozzle to the nozzle carrier is subjected to forces, which may cause increased wear. The same thing happens when the application nozzle encounters an obstacle. If the application nozzle becomes bent or otherwise damaged, a reliable material application is no longer possible.

It is therefore the task of the invention to further develop an apparatus of the type mentioned in the introduction in such a way that a higher process reliability is achieved.

This task is accomplished according to the invention by an apparatus having the features of claim 1. Advantageous further developments of the invention are subject matter of the dependent claims.

The invention is based on the idea that a limited movability of the application nozzle relative to the nozzle carrier reduces the wear of the structural parts since, during an action of external force on the application nozzle, for example in the case of occurrence of frictional forces during the movement of the nozzle on the workpiece surface or in the case of arrival against an obstacle, the application nozzle is able to evade the acting force, by moving relative to the nozzle carrier. External forces acting on the application nozzle are minimized thereby, and so the wear of the application nozzle as well as of the nozzle carrier is reduced. In addition, the robot track may be considerably simplified, since such high precision in the nozzle position is no longer required. Finally, the elastically movable application nozzle may also compensate for fabrication tolerances of the workpieces, so that gauging thereof may be omitted.

Expediently, the first connecting part has a cylindrical outer contour, whereas the second connecting part has a cylindrical inner contour. The limited movability of the application nozzle relative to the nozzle carrier is then achieved in that the outside diameter of the first connecting part is smaller than the inside diameter of the second connecting part. Expediently, an elastic O-ring disposed between the connecting parts is used as a restoring element.

In addition, this seals the connecting parts relative to one another and prevents the escape of material in the region of the connecting parts.

According to a preferred embodiment, the connecting parts are fastened detachably to one another by means of at least two connecting pins. Each of these connecting pins passes through both connecting parts at least partly and, transverse to its longitudinal extent, is disposed immovably in one of the connecting parts and in limitedly movable manner in the other connecting part. In this connection, it is preferred that the connecting pins, transverse to their longitudinal extent, are respectively immovable relative to the second connecting part and limitedly movable relative to the first connecting part. Furthermore, it is preferred that the connecting pins are disposed pairwise in a manner parallel to one another.

Expediently, the connecting pins respectively extend through a hole in the second connecting part and a recess in the first connecting part that is open toward the side in the shell surface of the first connecting part. In this case, it is preferred that the nozzle carrier is provided with the first connecting part while the application nozzle is provided with the second connecting part.

Figure 2:
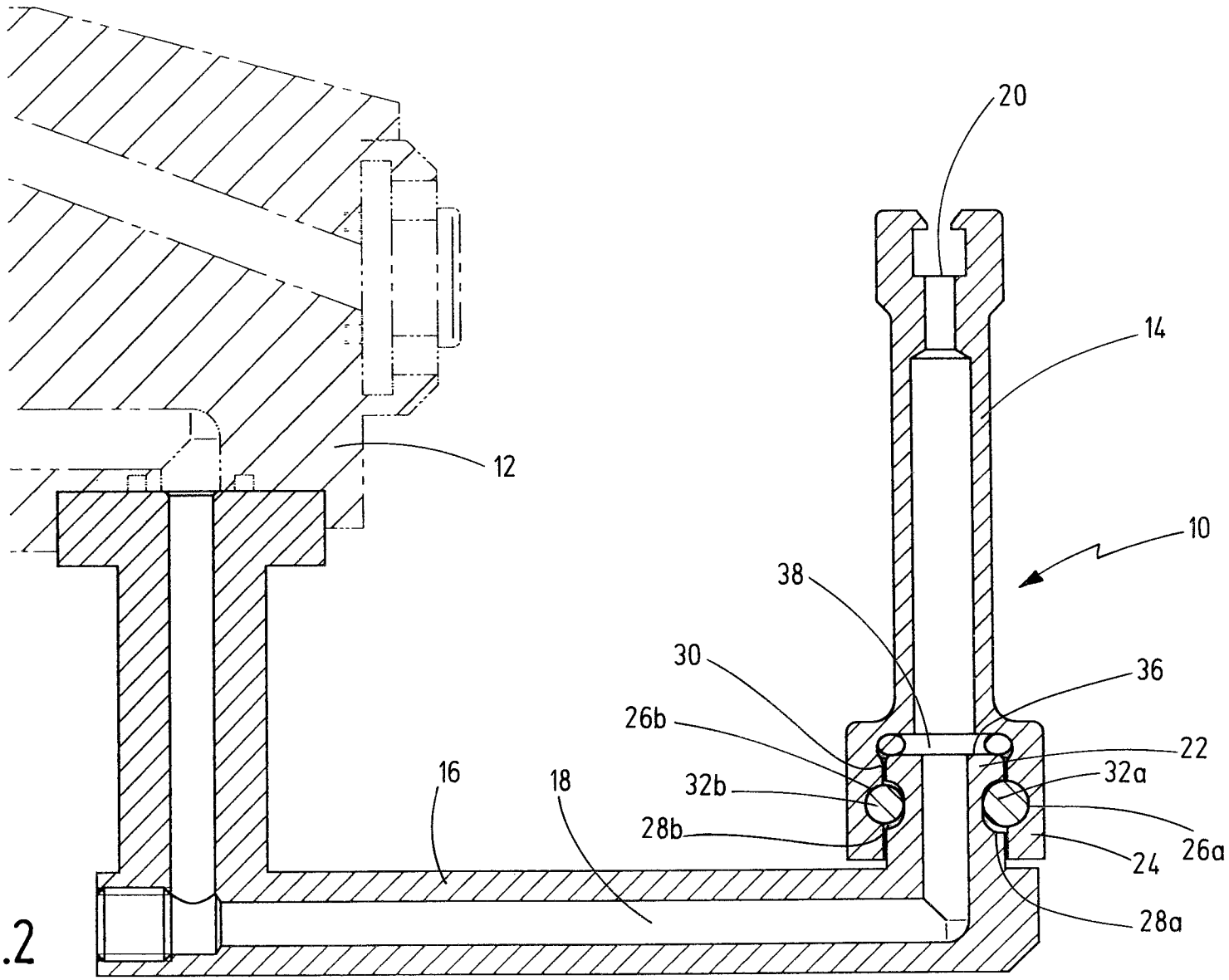

The invention will be explained in more detail in the following on the basis of an exemplary embodiment illustrated schematically in the drawing, wherein FIG. 1 shows an exploded diagram of an application apparatus and FIG. 2 shows the application apparatus according to FIG. 1 in assembled form in section.

The application apparatus 10 illustrated in the drawing is used for the application of viscous material such as adhesive or sealing compound onto workpieces, for example onto body structural parts in the fabrication of motor vehicles. It is mounted on a robot arm 12, which is illustrated schematically in the drawing and with the help of which it can be moved relative to the workpiece. The application apparatus 10 has an application nozzle 14, which is mounted detachably on a nozzle carrier 16. An application duct 18 for the viscous material extends through the nozzle carrier 16 and the application nozzle 14 up to a material outlet opening 20 at the free end of the application nozzle 14. The viscous material is introduced into the application duct 18 and conveyed in a manner forced under pressure to the material outlet opening 20, where it emerges and is applied onto the respective workpiece.

For fastening of the application nozzle 14 on the nozzle carrier 16, the nozzle carrier 16 has a first connecting part 22, which has a cylindrical outer contour. In contrast, the application nozzle 14 has, at its end turned toward the nozzle carrier 16, a second connecting part 24, which has a cylindrical inner contour and in which the first connecting part 22 is received, wherein the second connecting part 24 annularly surrounds the first connecting part 22. The said outside diameter of the first connecting part 22 is smaller than the inside diameter of the second connecting part 24, so that sufficient clearance is present between the two connecting parts 22, 24 that the application nozzle 14 may be tilted in limited manner relative to the nozzle carrier 16. Two holes 26*a*, 26*b* running parallel to one another and respectively communicating with a recess 28*a*, 28*b* open toward the side in the shell surface 30 of the first connecting part 22 extend through the second connecting part 24. A connecting pin 32*a*, 32*b*, the circular cross section of which corresponds to the cross section of the associated hole 26*a*, 26*b*, is inserted into each of the holes. Of those, a first connecting pin 32*a* has a larger diameter than a second connecting pin 32*b*. The two connecting pins 32*a*, 32*b* are joined to one another in one piece by means of a connecting element 34. Each of the recesses 28*a*, 28*b* has, transverse to the longitudinal extent of the connecting pins 32*a*, 32*b*, a width that is larger than the diameter of the associated hole 26*a*, 26*b*. In this way, the connecting pins 32*a*, 32*b* can be tilted in limited manner relative to the nozzle carrier 16, from which tilting of the application nozzle 14 joined immovably with them also results transverse to the longitudinal extent of the connecting pins 32*a*, 32*b*. An elastically deformable O-ring 38, which generates a restoring force opposing a tilting of the application nozzle 14 relative to the nozzle carrier 16 out of the basic position shown in FIG. 2 and in addition seals the connecting parts 22, 24 relative to one another, is disposed between the connecting parts 22, 24, in a manner resting on an end face 36 of the first connecting part 22. The connection between the application nozzle 14 and the nozzle carrier 16 is easy to loosen for removal of the application nozzle 14, in that the connecting pins 32*a*, 32*b* are grasped on the connecting element 34 and pulled out.

In summary, the following may be stated: The invention relates to an apparatus 10 for application of a viscous material onto a workpiece, especially for application of an adhesive or sealing compound onto a motor-vehicle body structural part, with an application nozzle 14 having a material outlet opening 20 and with a nozzle carrier 16, which carries the application nozzle 14 and on which the application nozzle 14 is fastened detachably, wherein an application duct 18 extends through the nozzle carrier 16 and the application nozzle 14 up to the material outlet opening 20. According to the invention, it is provided that the nozzle carrier 16 and the application nozzle 14 respectively have a connecting part 22, 24, wherein a first connecting part 22 is inserted into a second connecting part 24 and is annularly surrounded by this, and that the connecting parts 22, 24 are limitedly movable relative to one another out of a basic position against the restoring force of an elastic restoring element 38.

The invention claimed is:

1. An apparatus for application of a viscous material onto a workpiece with an application nozzle having a material outlet opening and with a nozzle carrier, which carries the application nozzle and on which the application nozzle is fastened detachably, wherein an application duct extends through the nozzle carrier and the application nozzle up to the material outlet opening, wherein the nozzle carrier and the application nozzle respectively have a first connecting part and a second connecting part, wherein the first connecting part is inserted into the second connecting part and is annularly surrounded by the second connecting part, and the first and second connecting parts are limitedly movable relative to one another out of a basic position against a restoring force of an elastic restoring element, and wherein the first and second connecting parts are fastened detachably to one another by means of at least two connecting pins, wherein each of the two connecting pins passes through both the first and second connecting parts at least partly and, transverse to its longitudinal extent, is disposed immovably in one of the first and second connecting parts and in a limitedly movable manner in another of the first and second connecting parts.

2. The apparatus according to claim 1, wherein the first connecting part has a cylindrical outer contour, wherein the second connecting part has a cylindrical inner contour and wherein the outside diameter of the first connecting part is smaller than the inside diameter of the second connecting part.

3. The apparatus according to claim 1, wherein the restoring element is an elastic O-ring disposed between the first and second connecting parts.

4. The apparatus according to claim 1, wherein the connecting pins, respectively transverse to their longitudinal extent, are immovable relative to the second connecting part and limitedly movable relative to the first connecting part.

5. The apparatus according to claim 1, wherein the connecting pins are disposed pairwise in a manner parallel to one another.

6. The apparatus according to claim 1, wherein the connecting pins respectively extend through a hole in the second connecting part and a recess in the first connecting part that is open toward the side of the shell surface in the first connecting part.

7. The apparatus according to claim 1, wherein the nozzle carrier is provided with the first connecting part and wherein the application nozzle is provided with the second connecting part.

* * * * *